US012578172B1

(12) United States Patent
Burchett et al.

(10) Patent No.: US 12,578,172 B1
(45) Date of Patent: Mar. 17, 2026

(54) SYSTEM AND METHOD FOR OBTAINING TRAINING MUNITION FIRING SIGNATURE

(71) Applicant: Lockheed Martin Corporation, Bethesda, MD (US)

(72) Inventors: Chase Mathias Burchett, Winter Springs, FL (US); Logan Tyler Little, Orlando, FL (US); William Thomas Wilkins, Orlando, FL (US); Kyle Thomas Smith, Orlando, FL (US); James Laughridge, Orlando, FL (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 18/928,699

(22) Filed: Oct. 28, 2024

(51) Int. Cl.
*F42B 8/08* (2006.01)
*F42B 8/02* (2006.01)
*F42B 8/18* (2006.01)

(52) U.S. Cl.
CPC ..... *F42B 8/18* (2013.01)

(58) Field of Classification Search
CPC ..... F42B 8/08; F42B 8/02
See application file for complete search history.

(56) References Cited

U.S. PATENT DOCUMENTS 1,645,881 A * 10/1927 Strong ..... F41A 33/02 362/310
2,405,308 A * 8/1946 Jack ..... F42B 8/02 73/167
2,482,436 A * 9/1949 Ream ..... F41A 19/29 446/52
3,334,587 A * 8/1967 Stadler ..... F42B 14/02 102/447
3,347,491 A * 10/1967 Auguste ..... F42B 10/12 102/400
3,510,965 A * 5/1970 Rhea ..... F41G 3/2655 434/21
3,938,262 A * 2/1976 Dye ..... F41G 3/2655 434/21

(Continued)

FOREIGN PATENT DOCUMENTS

FR 3128283 A1 4/2023
WO WO-2022/169613 A2 8/2022

OTHER PUBLICATIONS

U.S. Army, Program Executive Office Soldier, M320/M320A1 Grenade Launcher Module (GLM), archived Apr. 18, 2024, accessed at https://web.archive.org/web/20240418040133/https://www.peosoldier.army.mil/Equipment/Equipment-Portfolio/Project-Manager-Soldier-Lethality- Portfolio/M320-M320A1-Grenade-Launcher-Module/.

(Continued)

*Primary Examiner* — Derrick R Morgan
(74) *Attorney, Agent, or Firm* — Foley & Lardner LLP

(57) ABSTRACT

A training munition assembly for use with a weapon includes a case, a first firing element, and a release assembly. The case defines an interior cavity. The first firing element is disposed within the interior cavity. The release assembly is coupled to the case and engages the first firing element. The release assembly is configured to cause movement of the first firing element from a first position within the interior cavity to a second position within the interior cavity responsive to actuation of the release assembly from outside of the case. Movement of the first firing element is configured to generate a firing signature that is indicative of actuation of the release assembly.

18 Claims, 8 Drawing Sheets

(56) References Cited

U.S. PATENT DOCUMENTS

| | | | | | |
|---|---|---|---|---|---|
| 4,678,437 | A * | 7/1987 | Scott | F41A 33/02 | 434/21 |
| 5,488,795 | A * | 2/1996 | Sweat | F41A 33/02 | 362/112 |
| 5,677,505 | A * | 10/1997 | Dittrich | F42B 5/02 | 102/444 |
| 5,716,216 | A * | 2/1998 | O'Loughlin | F41A 33/02 | 273/365 |
| 5,787,631 | A * | 8/1998 | Kendall | F41A 33/02 | 42/116 |
| 6,178,889 | B1 * | 1/2001 | Dindl | F42B 5/02 | 102/446 |
| 6,189,454 | B1 * | 2/2001 | Hunt | F42B 12/74 | 102/444 |
| 6,389,730 | B1 * | 5/2002 | Millard | F41A 33/02 | 42/116 |
| 6,439,123 | B1 * | 8/2002 | Dionne | F42B 5/02 | 102/444 |
| 6,564,719 | B2 * | 5/2003 | Saxby | F42B 8/02 | 102/446 |
| 8,327,767 | B2 * | 12/2012 | Lafortune | F42B 8/02 | 102/446 |
| 10,712,135 | B1 * | 7/2020 | Bullock | F42B 8/08 | |
| 2004/0211103 | A1 * | 10/2004 | Aske | F41A 17/44 | 42/70.11 |
| 2017/0211905 | A1 | 7/2017 | Monti et al. | | |
| 2021/0215450 | A1 | 7/2021 | Monti | | |
| 2022/0146238 | A1 * | 5/2022 | Doiron | F42B 5/045 | |
| 2023/0341216 | A1 * | 10/2023 | Monti | F41A 33/02 | |
| 2024/0384962 | A1 * | 11/2024 | Schaap | F41A 33/02 | |
| 2025/0003720 | A1 * | 1/2025 | Monti | F41A 33/02 | |

OTHER PUBLICATIONS

R. Bellamy et al., Eds., Conventional Warfare: Ballistic, Blast and Burn Injuries, Ch. 1, The Weapons of Conventional Land Warfare, pp. 37-44 (1991).

International Search Report & Written Opinion on International Patent Application No. PCT/US2025/041472 dated Jan. 29, 2026 (23 pages).

* cited by examiner

SYSTEM AND METHOD FOR OBTAINING TRAINING MUNITION FIRING SIGNATURE

STATEMENT REGARDING FEDERALLY SPONSORED RESEARCH OR DEVELOPMENT

This invention was made with government support under Contract No. W900KK-23-9-0015 awarded by the United States Department of Defense. The government has certain rights in the invention.

FIELD

The present disclosure relates generally to the field of weapon munitions for training activities.

BACKGROUND

Training exercises for military, law enforcement, and security personnel may involve the use of armament in a simulated combat zone. Such training exercises can also provide valuable data to military decision-makers and suppliers regarding how users interact with and use their weapons throughout the training exercise, including the number of times that the weapon has been fired and the circumstances resulting in a firing event.

SUMMARY

One aspect of the present disclosure relates to a training munition assembly that includes a case, a first firing element, and a release assembly. The case defines an interior cavity. The first firing element is disposed within the interior cavity. The release assembly is coupled to the case and engages the first firing element. The release assembly is configured to cause movement of the first firing element from a first position within the interior cavity to a second position within the interior cavity responsive to actuation of the release assembly from outside of the case. Movement of the first firing element is configured to generate a firing signature that is indicative of actuation of the release assembly.

Another aspect of the present disclosure relates to a training munition assembly that includes a case, a plurality of firing elements, and a release assembly. The case defines an interior cavity. The plurality of firing elements is disposed within the interior cavity. The release assembly is actuatable to selectively allow movement of the plurality of firing elements along the interior cavity. The plurality of firing elements is configured to move at different rates along the interior cavity responsive to actuation of the release assembly.

Yet another aspect of the present disclosure relates to a method of manufacturing a training munition assembly. The method includes coupling a release assembly to a case so that the release assembly extends into an interior cavity that is defined by the case; inserting a first firing element into the interior cavity; and engaging the first firing element with the release assembly such that actuation of the release assembly causes movement of the first firing element from a first position within the interior cavity to a second position within the interior cavity.

This summary is illustrative only and should not be regarded as limiting.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
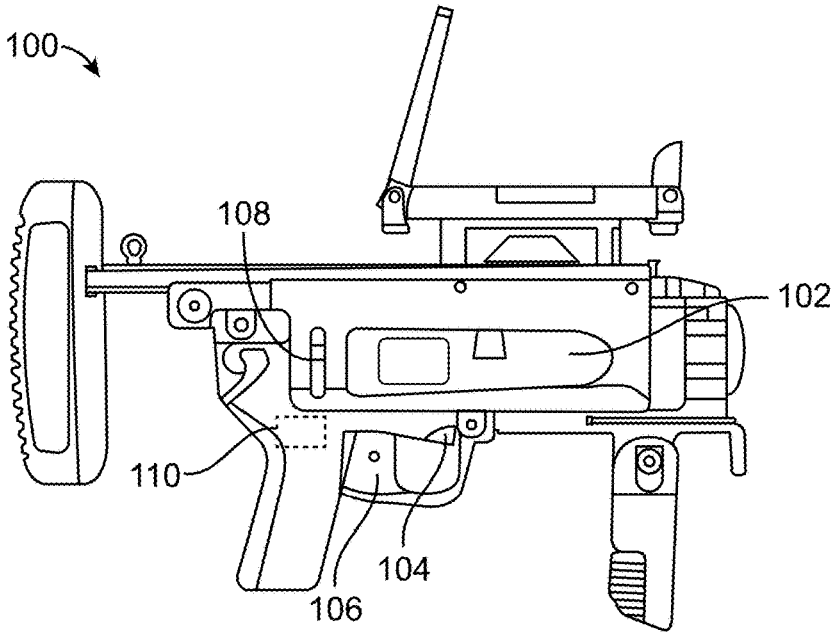
FIG. 1 is a side view of a weapon, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Training exercises for military, law enforcement and security personnel (e.g., warfighters, soldiers, users, etc.) may involve the use of weapons in different situations to simulate how the weapons will be used in an actual combat zone or mission. These training exercises typically involve the use of a simulated and/or training munition (e.g., a training ammunition, etc.) for the weapon that can be fired without risk of bodily injury to other military personnel involved in the training exercise. The data provided by such training exercises can be valuable to various parties, including military decision-makers, such as personnel charged with training and readiness, and/or manufacturers such as suppliers. For example, military leadership may desire to track the number of times a weapon has been fired during a training exercise by a user, under what situations the weapon is being used, and/or other weapon operation metrics. Use of the weapons during training exercises can also help increase operator understanding of the weapon and its characteristics (e.g., the weapon recoil associated with a firing event, etc.).

Embodiments of the present disclosure relate to a training munition assembly (e.g., a training ammunition, etc.) for a weapon that is configured to accurately simulate operator interaction with the weapon during weapon loading and firing events. The training munition assembly is configured to provide a reliable and repeatable indication of when the weapon has been fired by generating a firing signature responsive to actuation of the weapon firing pin. The firing signature can be detected by one or more sensors, such as an accelerometer mounted on the weapon body, which can be logged by a data recorder or transmitted off-weapon to a training facility (e.g., a control center) to provide valuable data to military leadership and weapon suppliers regarding how the weapon is being used.

In some embodiments, the training munition assembly is configured to produce a firing signature (e.g., acceleration signature and/or profile, etc.) when actuated/fired by a weapon. The firing signature may be difficult to replicate through manual manipulation of the weapon (e.g., striking the weapon, dropping the weapon, etc.). In some embodiments, the firing signature produced by the training munition assembly includes multiple acceleration pulses associated with the movement of multiple elements within the training munition assembly that are released responsive to firing/actuation of the weapon. These elements may have different shapes and/or masses, may be made from different materials, and/or may be actuated by different springs, which causes the elements to move at different speeds within the training munition assembly. The impact between the elements and/or between the elements and inner walls within the munition casing, generates an acceleration profile (e.g., multiple pulses in a time sequence, a waveform shape, etc.) that can be captured by the accelerometer.

The training munition assembly may be configured to generate a consistent firing signature, which can facilitate detection by an accelerometer-based detection system. Among other benefits, the firing signature produced by the training munition assembly can be customized to produce an acceleration profile that is difficult to simulate, which can reduce the risk of false positives (e.g., procedural violations or improprieties, cheating, etc.) by military personnel during use and/or as a result of impacts imparted to the weapon that are not part of a firing event. Additionally, in some embodiments, a spring-loaded actuation mechanism within the training munition assembly can eliminate the need to include batteries or other expendable items with the training munition assembly, which can add weight and increase the likelihood of failure during a training exercise, or impede readiness for training (e.g., if the batteries are uncharged or malfunctioning). The training munition assembly (e.g., the position of the firing elements, etc.) may be reset after use, thereby enabling the training munition assembly to be used multiple times without tearing down or replacing the device.

FIG. 1 depicts a weapon 100 for use with a training munition assembly, according to an embodiment. The weapon 100 may be a military-issue rifle, grenade launcher, or other firearm or military armament. In the embodiment of FIG. 1, the weapon 100 is a grenade launcher (e.g., an M320 grenade launcher, an M433 grenade launcher, and M406 grenade launcher, etc.). The weapon 100 includes a barrel 102, a barrel release 104, and a trigger 106. The barrel 102 is configured to receive ammunition (e.g., grenades, etc.) and to support the ammunition within the weapon 100 during a firing event. The barrel 102 defines a breach 108 (e.g., an opening for ammunition, etc.) for inserting the ammunition into the barrel 102.

The barrel release 104 is configured to disengage one end of the barrel 102 and expose the breach 108 so that a grenade can be loaded into the barrel 102. The trigger 106 is configured to actuate a firing pin within the weapon 100, and to activate ammunition that has been loaded into the weapon 100. In at least one embodiment, the weapon 100 further includes an accelerometer, such as a micro-electromechanical systems (MEMS) accelerometer 110 that is configured to measure vibrational forces from the weapon 100 (e.g., from firing the weapon, etc.) during use. In some embodiments, the MEMS accelerometer 110 is mounted to the weapon 100 in a position that enables at least an indirect measurement of the acceleration imparted to the frame of the weapon 100 by the training ammunition assembly.

Example Training Munition Assembly

Figure 2:
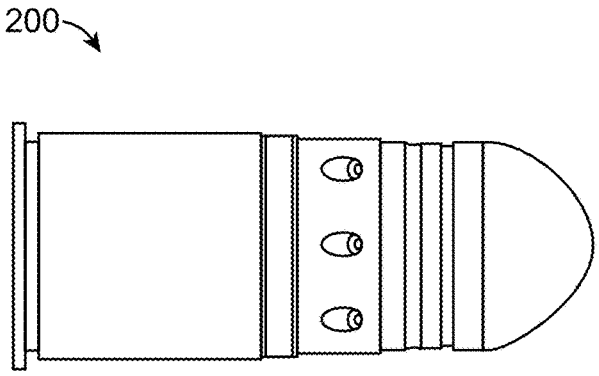
FIG. 2 is a side view of a training munition assembly for use with the weapon of FIG. 1, according to an embodiment.
Figure 3:
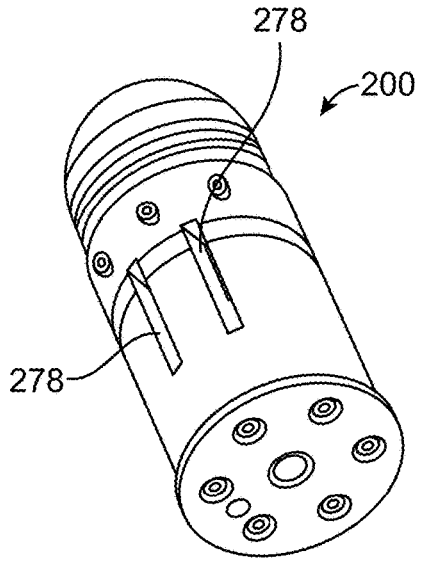
FIG. 3 is a perspective view of the training munition assembly of FIG. 2.

FIGS. 2-3 depict a training munition assembly 200 (e.g., training ammunition, etc.) that may be used with the weapon 100 of FIG. 1. The training munition assembly 200 is a simulated grenade (e.g., a grenade cartridge intended for training exercises, etc.) that has a similar shape and appearance to an actual grenade for the weapon 100. In other embodiments, the training munition assembly 200 may be another type of cartridge for any other type of weapon (e.g., an assault rifle, a pistol, a machine gun, etc.).

Figure 4:
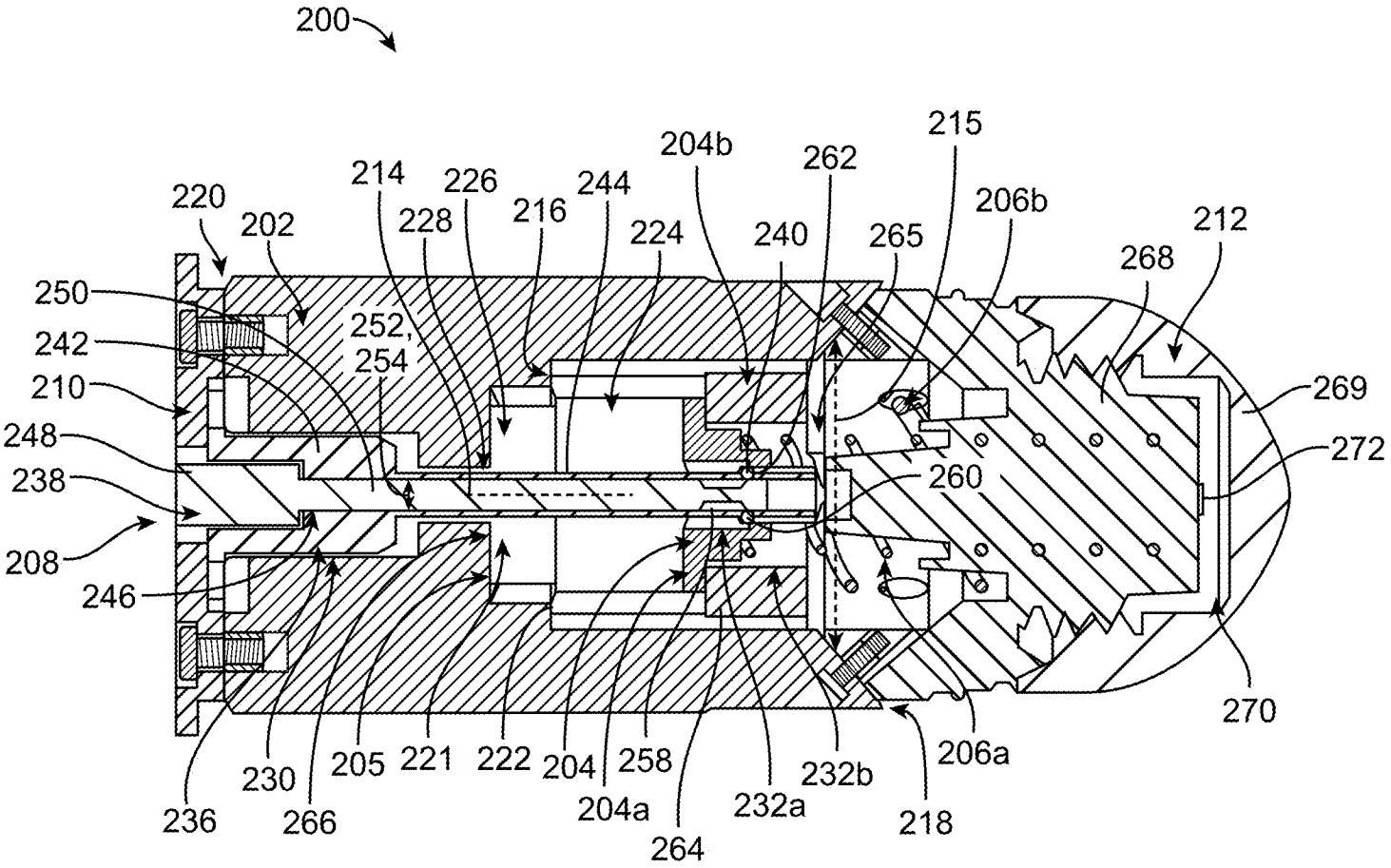
FIG. 4 is a side cross-sectional view of the training munition assembly of FIG. 2.

Referring to FIG. 4, the training munition assembly 200 includes a case 202, a plurality of firing elements, shown as firing elements 204; a plurality of spring elements, shown as spring elements 206; a release assembly 208; a retaining cover 210; and a nose cover 212. In other embodiments, the training munition assembly 200 may include additional, fewer, and/or different components.

The case 202 is an enclosure that is configured to contain and support various components of the training munition assembly 200. The case 202 has a substantially cylindrical shape having a circular outer profile (e.g., a circular cross-sectional shape) normal to a central axis 214 of the case 202. In the embodiment of FIG. 4, the case 202 has a similar profile (e.g., shape, etc.) as a shell casing for the weapon. In other embodiments, the shape of the case 202 may be different.

The case 202 defines an interior cavity 216 (e.g., an internal cavity, a hollow region, an internal volume, etc.) that is sized to receive various components of the training munition assembly 200 therein (e.g., the firing elements 204, the spring element 206, at least a portion of the release assembly 208, etc.). The interior cavity 216 is a recessed area that extends from a first axial end 218 (e.g., an open end, etc.) of the case toward a second axial end 220 (e.g., a closed end, etc.) of the case 202 that is terminated by the retaining cover 210. In the embodiment of FIG. 4, the interior cavity 216 is a cylindrical shaped cavity having a circular profile relative to the central axis 214 of the case 202. In other embodiments, the cross-sectional shape of the interior cavity 216 may be different.

In the embodiment of FIG. 4, the case 202 is tapered at the first axial end 218 thereof such that an inner diameter 215 of the interior cavity 216 decreases (e.g., continuously, without stepwise transition, etc.) moving away from the first axial end 218 of the case 202.

The case 202 defines at least one step 222 (e.g., ledges, etc.) at a distal end 221 of the interior cavity 216 opposite from the first axial end 218. The step 222 defines a stepwise change in inner diameter of the interior cavity 216 that divides the interior cavity 216 into a first region 224 and a second region 226. In the embodiment of FIG. 4, the second region 226 is arranged concentric with the first region 224.

The case 202 also defines a recessed area 230 that extends from the second axial end 220 of the case 202 toward the interior cavity 216. As will be further described, the recessed area 230 is sized to receive at least a portion of the release assembly 208 therein and to support the release assembly in position with respect to the interior cavity 216. The case 202 also defines a through-hole opening 228 (e.g., a passage, etc.) that extends from a distal end 221 of the interior cavity 216 to the recessed area 230.

The firing elements 204 (e.g., movable elements, movable masses, etc.) are configured to move within the case 202 responsive to a firing event, and to impact an inner wall/surface of the case 202, thereby generating a firing signature indicating that the weapon has been fired. In the embodiment of FIG. 4, the firing elements 204 include a first firing element 204*a* and a second firing element 204*b* that are configured to move relative to the case 202 responsive to a firing event. In other embodiments, the training munition assembly 200 may include more or fewer firing elements.

The firing elements 204 are disposed within the interior cavity 216 and are movably (e.g., slidably) engaged with the interior cavity 216. In the embodiment of FIG. 4, the firing elements 204 are ring-shaped masses (e.g., rings) that each define a central opening therethrough. The first firing element 204*a* is a substantially cylindrical ring that defines at least two steps along an outer radial surface thereof (e.g., at least one stepwise change in diameter along the outer surface, etc.). The first firing element 204*a* has a uniform inner diameter along an entire axial length of the first firing element 204*a*. The number and/or arrangement of steps along the first firing element 204*a* may be different in various embodiments. In other embodiments, the shape of the first firing element 204 may be different. For example, the first firing element 204*a* may be formed in a pyramid shape that has a substantially triangle shaped cross-section normal to a circumferential direction relative to a central axis of the first firing element 204*a*. The cross-sectional shape of the first firing element 204*a* normal to a central axis thereof may also be different in various embodiments. For example, the first firing element 204*a* may be formed as a hollow right prism having a triangular cross-section, a rectangular cross-section, a hexagonal cross-section, etc. when viewed normal to a central axis of the first firing element 204*a*. In other embodiments, the first firing element 204*a* may define an elliptical cross-sectional shape normal to a central axis of the first firing element 204*a*. The second firing element 204*b* may be formed in a same and/or different shape from the first firing element 204*a*. For example, in the embodiment of FIG. 4, the second firing element 204*b* is a cylindrical ring having uniform inner and outer diameter along an entire axial length of the first firing element 204*b*.

The first firing element 204*a* is slidably engaged with the release assembly 208 along an inner surface of the central opening 232*a*. The central opening 232*b* of the second firing element 204*b* is sized to receive at least a portion of the first firing element 204*a* therein and to accommodate a first spring element 206*a* of the plurality of spring elements 206 that engages the first firing element 204*a*, as will be further described.

In the embodiment of FIG. 4, the second firing element 204*b* is slidably engaged with the case 202 along an inner surface of the case 202. The second firing element 204*b* is engaged with the first firing element 204*a* so that the first firing element 204*a* substantially prevents movement of the second firing element 204*b* in at least one direction (e.g., axially as shown in FIG. 4) in the first position 264 and/or the second position 266. In the embodiment of FIG. 4, an axial end of the second firing element 204*b* is engaged with and supported by the first firing element 204*a* in the first position 264 along an axial direction, which prevents movement of the second firing element 204*b* away from the nose cover 212. In the second position 266, the axial end of the second firing element 204*b* is engaged with the step 222 (see FIG. 8). In other embodiments, such as when the mass of each firing element 204 and/or the spring force applied to each firing element 204 is different, the axial end of the second firing element 204*b* is engaged with an axial end of the first firing element 204*a* in the second position 266 so that the first firing element 204*a* also prevents axial movement of the second firing element 204*b* away from the nose cover 212 in both the first position 264 and the second position 266.

In the embodiment of FIG. 4, the first firing element 204*a* has a different shape (e.g., cross-sectional shape, outer profile, etc.) than the second firing element 204*b*, which can affect acceleration of the first firing element 204*a* relative to the second firing element 204*b* during a firing event, as will be further described. In other embodiments, the first firing element 204*a* may have a different density as the second firing element 204*b* (e.g., may be made from a different material than the second firing element 204*b*), and/or may have another different acceleration performance characteristic from the second firing element 204*b*. The first firing element 204*a* and the second firing element 204*b* are configured to move along the interior cavity 216 responsive to actuation of the release assembly 208.

The release assembly 208 is actuatable to selectively allow movement of the plurality of firing elements 204 along the interior cavity 216, from a first position 264 (e.g., an unfired position, etc.) within the interior cavity 216 to a second position 266 (e.g., a fired position, etc.) within the interior cavity 216 that is spaced apart from the first position 264. In the first position 264, the release assembly 208 supports the firing elements 204 at a first axial end 265 of the interior cavity 216 (as shown in FIG. 4). In the second position 266, the release assembly 208 allows the firing elements 204 to move away from the first position toward a second axial end (e.g., the distal end 221) of the interior cavity 216 that spaced apart from the first axial end 265 (see FIG. 8).

Figure 7:
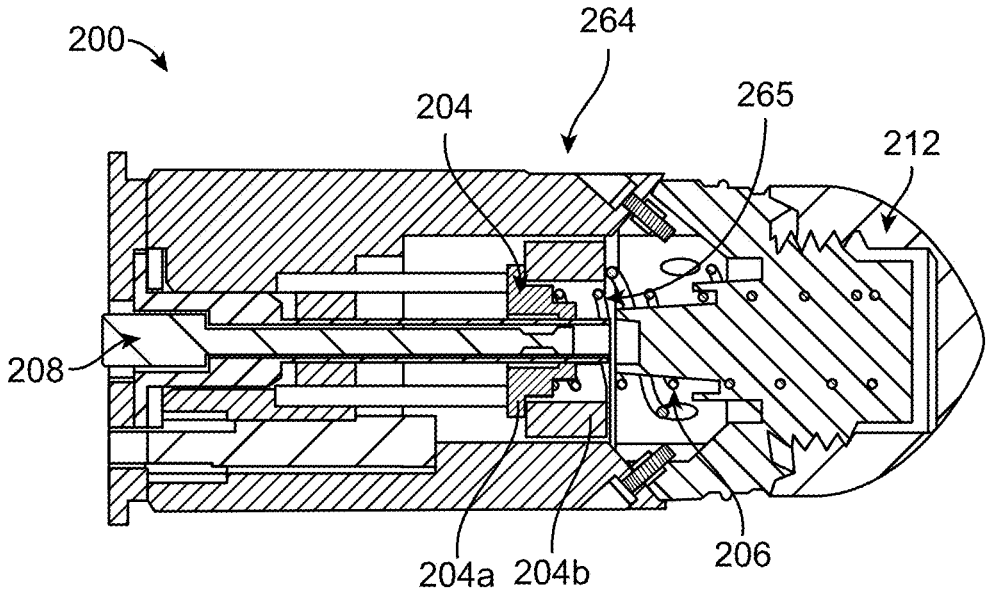
FIG. 7 is a side cross-sectional view of the training munition assembly of FIG. 2, shown with the training munition assembly in an unfired condition, according to an embodiment.

The second firing element 204*b* is configured to move independently form the first firing element 204*b* as the first firing element 204*a* moves from the first position 264 to the second position 266. The position of each of the firing elements 204 may be different in each of the first position 264 (e.g., fired position, etc.) and the second position 266 (e.g., unfired position, etc.). For example, and referring to FIGS. 7-8, the release assembly 208 may be configured to cause movement of the first firing element 204*a* from a first position 264*a* within the interior cavity 216 to a second position 266*a* within the interior cavity 216, and to cause movement of the second firing element 204*b* from a third position 264*b* within the interior cavity 216 to a fourth position 266*b* within the interior cavity 216. The first position 264*a* and the second position 266*a* may be different from the third position 264*a* and the fourth position 266*b*, respectively. In other embodiments, the first position 264*a* and the second position 266*a* are the same as the third position 264*b* and the fourth position 266*b*, respectively. The distances between (i) the first position 264*a* and the second position 264*b*, and (ii) the third position 264*b* and the fourth position 266*b* may also be the same or different in various embodiments.

The release assembly 208 is coupled to the case 202 and engages at least one of the firing elements 204. The release assembly 208 includes a release pin 236, a release actuator 238, and a firing element support 240.

In the embodiment of FIG. 4, the release pin 236 is coupled to the case 202 at the second axial end 220 of the case 202 by a bolt, the retaining cover 210, or another type of mechanical fastener. In other embodiments, the release pin 236 may be welded or otherwise permanently affixed to the case 202. The release pin 236 includes a pin base 242 that is disposed within the recessed area 230 of the case 202, and a pin extension 244 extending axially away from the pin base 242. The pin extension 244 extends substantially parallel to the central axis 214 of the case 202. The pin extension 244 extends through the through-hole opening 228 and into the interior cavity 216. The release pin 236 is a hollow cylindrical pin defining a hollow interior 246 that extends through both the pin base 242 and the pin extension 244.

The release actuator 238 is coupled to the release pin 236 and is at least partially disposed within a hollow interior 246 of the release pin 236. The release actuator 238 includes a release button 248 at a first axial end of the release actuator 238 (e.g., proximate to the retaining cover 210, etc.), and an extension element 250 extending axially away from the release button 248 and into the hollow interior 246 of the release pin 236.

The extension element 250 is configured to engage the firing element support 240 at a distal end of the release pin 236 and to actuate the firing element support 240 responsive to actuation of the release button 248 (e.g., responsive to movement of the release actuator 238 relative to the release pin 236). An outer diameter 252 of the extension element 250 is approximately equal to an inner diameter 254 of the hollow interior 246 of the release pin 236.

The extension element 250 includes a circumferential slot 258 that is offset from a distal end of the extension element 250. The circumferential slot 258 defines a region of reduced diameter along an axial portion of the extension element 250. In the embodiment of FIG. 4, each axial end of the circumferential slot 258 is tapered in a frustoconical shape to define a smooth and continuous transition from the distal end of the extension element 250 to the circumferential slot 258. Beneficially, the tapered ends of the circumferential slot 258 facilitate movement of the firing element support 240 into and out of the circumferential slot 258 during a firing event.

The firing element support 240 is configured to selectively engage at least one of the firing elements 204 based on a position of the release actuator 238 to control movement of at least one of the firing elements 204. In the embodiment of FIG. 4, the firing element support 240 includes a pair of spherical elements 260 (e.g., spherical ball elements, etc.). The spherical elements 260 are disposed in opposite sides of the release pin 236 at a distal end of the release pin 236. In the embodiment of FIG. 4, the spherical elements 260 are disposed on opposing ends of a transverse opening 262 that extends through the release pin 236 (e.g., the pin extension 244). In other embodiments, the firing element support 240 may include another form of movable radial and/or axial extension that is configured to engage (e.g., contact) at least one of the firing elements 204 and to maintain an axial position of the at least one firing element 204 within the interior cavity 216 in an unfired position.

The spring elements 206 are configured to (i) support the plurality of firing elements 204 in compression against the release assembly 208 when the firing elements 204 are in a first position 264 within the interior cavity 216, and (ii) to propel the firing elements 204 away from the first position 264 responsive to actuation of the release assembly 208.

The spring elements 206 include a first spring element 206*a* extending axially between the nose cover 212 and the first firing element 204*a*, and a second spring element 206*b* extending axially between the nose cover 212 and the second firing element 204*b*. In the embodiment of FIG. 4, the second spring element 206*b* circumscribes the first spring element 206*a*. For example, the second spring element 206*b* can surround or encircle the first spring element 206*a*. In some embodiments, the first spring element 206*a* has a first spring force characteristic, and a second spring element 206*b* has a second spring force characteristic that is different from the first spring force characteristic. The spring force characteristic may include features of the spring elements that affect performance of the springs under compression. The spring force characteristic may be a spring stiffness (e.g., a spring constant that is proportional to a restoring force exerted by the spring when moved over a distance, etc.), a spring wire diameter, a pitch between turns of the spring, and/or other characteristics regarding spring performance.

In at least one embodiment, the spring elements 206 further include a spring element disposed axially between the release pin 236 and the release actuator 238 that is configured to reposition the release actuator 238 after actuation of the release assembly 208 (i.e., to reset a position of the release assembly 208 and/or the firing element support 240 after actuation).

The retaining cover 210 (e.g., retaining cap, etc.) is configured to enclose the second axial end 220 of the case 202. In some embodiments, the retaining cover 210 is also configured to couple the release pin 236 to the case 202 at the pin base 242 of the release pin 236. In such embodiments, the pin base 242 may be at least partially disposed axially between the retaining cover 210 and the case 202. In the embodiment of FIG. 4, the retaining cover 210 is coupled to the case 202 using bolts or another type of mechanical fastener. In other embodiments, the retaining cover 210 may be welded or otherwise permanently affixed to the case 202.

The nose cover 212 is configured to enclose the interior cavity 216 at the first axial end 218 of the case 202. The nose cover 212 includes a nose cover body 268 and a nose cap 269 that is coupled to the nose cover body 268. In other embodiments, the nose cover 212 may be formed as a unitary cover from a single piece of material.

In the embodiment of FIG. 4, the nose cover body 268 is at least partially disposed within the interior cavity 216, for example, within the tapered end of the interior cavity 216. Such an arrangement enables the use of bolts or another type of mechanical fastener to couple the nose cover body 268 to the case 202 along the tapered end of the interior cavity 216. Beneficially, such an arrangement can improve the strength of the connection between the nose cover body 268 and the case 202. Such an arrangement can also eliminate the need for bolt holes through a forward end of the nose cover body 268 that extends away from the case 202, which can improve the overall aesthetic of the training munition assembly 200. In other embodiments, the nose cover 212 may be welded or otherwise permanently affixed to the case 202.

In the embodiment of FIG. 4, the nose cover body 268 engages an axial end of the spring elements 206 and supports the spring elements 206 in compression against the firing elements 204.

The nose cap 269 and the nose cover body 268 together define an inner cavity 270 (e.g., an inner volume, etc.) that is configured to receive an identification tag and/or tracking device therein. For example, the inner cavity 270 may be sized to receive a radio-frequency identification (RFID) tag 272 that enables wireless identification and tracking of the training munition assembly 200. The data from the RFID tag 272 may also provide metadata that can be applied to the firing event, such as the weapon type, ammunition type, and/or other metadata associated with the weapon and/or training munition assembly 200. In other embodiments, another form of identification and/or tracking device may be disposed within the inner cavity 270. In some embodiments, the nose cap 269 is threadably coupled to the nose cover body 268, which enables access to and removal of the RFID tag 272 from the training munition assembly 200.

The nose cover 212 (e.g., the nose cap 269 and the nose cover body 268 together) have a bullet shape (e.g., an ogive shape, a hemispherical shape, etc.) that is configured to resemble the appearance of actual ammunition for the weapon. The cylindrical shape of the case 202 is configured to resemble the appearance of a shell casing for the ammunition. The case and the nose cover 212 together define a simulated munition casing (e.g., having the appearance of an actual round of ammunition that is used with the weapon) that is insertable into a breech or magazine of a weapon.

Figure 5:
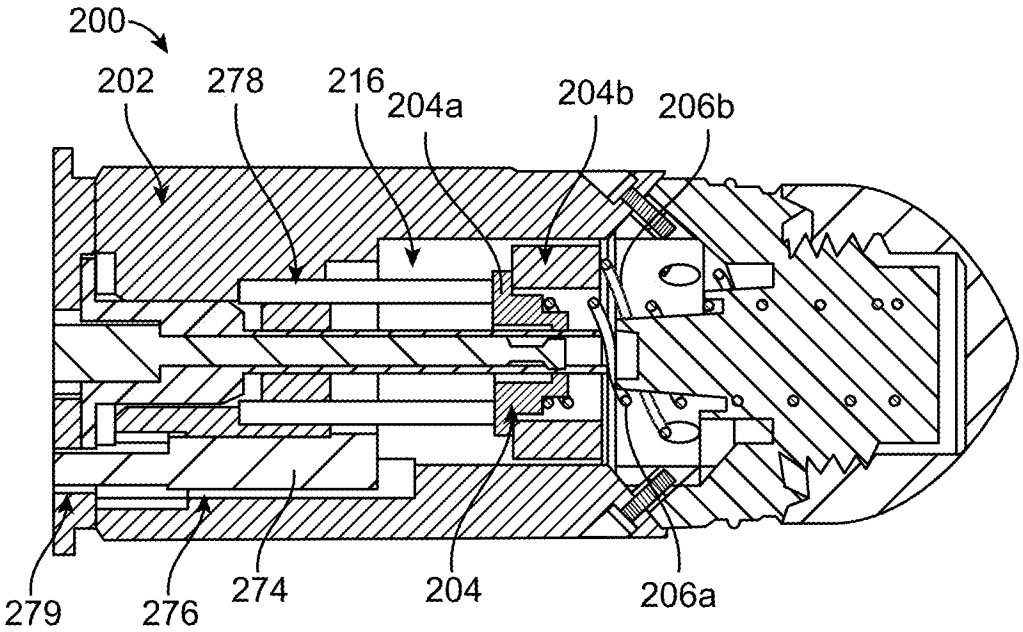
FIG. 5 is a side cross-section view of the training munition assembly of FIG. 2 taken through a discharge indicator of the training munition assembly, according to an embodiment.

Referring to FIG. 5, in some embodiments, the training munition assembly 200 further includes a discharge indicator 274 that is configured to provide a visual indication of whether the firing elements 204 are in the first position 264 or the second position 266. The discharge indicator 274 includes a pin or tab that is coupled to the case 202. The discharge indicator 274 is disposed within an opening 276 defined by the case 202 that extends parallel to the recessed area 230 and into a perimeter portion of the interior cavity 216. In the embodiment of FIG. 5, an inner radial wall of the opening 276 is approximately aligned with an inner radius of the step 222 and extends axially beyond the step 222. In such an arrangement, the opening 276 is positioned to align the discharge indicator 274 with a radial position at which the second firing element 204*b* is located.

In at least one embodiment, the training munition assembly 200 also includes a spring element 206*c* that is engaged with the discharge indicator 274 and that presses the discharge indicator at least partially into the interior cavity 216. During a firing event, the second firing element 204*b* contacts the discharge indicator 274, overcoming the spring force associated with the spring element 206*c*, and pushing the discharge indicator 274 into a window 279 (e.g., a through-hole opening, etc.) defined by the retaining cover 210. The discharge indicator 274 can be viewed through the window 279, which provides a visual indication to a user that the release assembly 208 has been actuated.

In at least one embodiment, the training munition assembly 200 also includes a reset mechanism and/or system that is configured to reset the firing elements 204 (e.g., from the second position 266 to the first position 264) after a firing event. In the embodiment of FIG. 5, the case 202 further defines a plurality of elongated slots, shown as reset apertures 278 that extend across an intermediate axial portion of the case 202. The reset apertures 278 extend substantially parallel to one another.

The reset apertures 278 extend along the interior cavity 216 and provide access to the interior cavity 216 from outside of the case 202. In the embodiment of FIG. 5, the reset apertures 278 are spaced a uniform distance from the sidewalls of the interior cavity 216 (and from the release assembly 208) to provide a balanced application of force to the firing elements 204 during the resetting operation.

During a reset operation, a user inserts a tool (e.g., a pronged tool, etc.) into the reset apertures 278 at a first axial end of the reset apertures 278 so that extensions from the tool engage a lower end of the firing element(s) 204 on both sides of the firing element(s) 204. The tool may also be configured to coordinate actuation of the release assembly 208 during the resetting operation. For example, the tool may be configured to actuate the release assembly 208 by depressing the release button 248 while sliding the tool from the first end of the reset apertures 278 to the second end of the reset apertures 278, and/or during insertion of the tool through the reset apertures 278 (as the tool is pushed toward the case 202). Once actuated, the tool may be configured to slide the firing element(s) 204 across the firing element support 240 and back to the first position 264. The tool may be configured to disengage the release assembly 208 after returning the firing element(s) 204 to the first position 264, thereby locking the firing element(s) 204 in position for the next firing event.

Many variations of the release system/mechanism are possible in other embodiments. For example, in some embodiments, the release system/mechanism includes openings in the retaining cover 210 that are configured to facilitate access to the interior cavity and at least one of the firing elements 204 (e.g., a lower surface of the first firing element 204*a*, etc.). In other embodiments, the release system/mechanism may include a magnetic actuator, which could facilitate repositioning of the firing elements 204 without requiring access to the interior cavity 216.

Notwithstanding the embodiments described above in reference to FIGS. 2-5, various modifications and inclusions to those embodiments are contemplated and considered within the scope of the present disclosure.

Method of Operating a Training Munition Assembly

Figure 6:
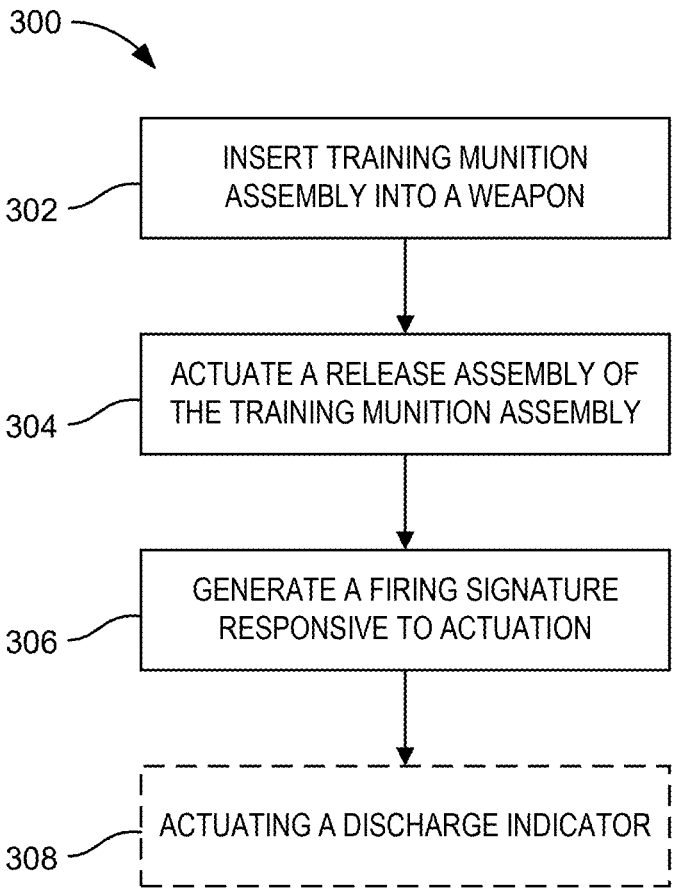
FIG. 6 is a flow diagram of a method of actuating a training munition assembly, according to an embodiment.

Referring to FIG. 6, a method 300 of actuating a training munition assembly is shown, such as the training munition assembly 200 of FIGS. 2-5, according to an embodiment. The method 300 may be implemented using the weapon 100 of FIG. 1. In other embodiments, the method 300 may include additional, fewer, and/or different operations.

At operation 302, the training munition assembly is inserted (e.g., loaded) into a weapon. In some embodiments, operation 302 includes inserting the training munition assembly into a barrel and/or through a breach of a weapon and cocking the weapon by pulling back a hammer or slide.

At operation 304, a release assembly of the training munition assembly is actuated. Operation 304 may include pulling a trigger of the weapon to activate a firing pin of the weapon. In such embodiments, and with reference to FIG. 7, operation 302 includes engaging the firing pin with a release assembly 208 of the training munition assembly 200 (e.g., a release actuator, a release button, etc.). The release assembly 208 is configured to cause movement of both the first firing element 204*a* and the second firing element 204*b* responsive to actuation of the release assembly 208.

At operation 304, responsive to actuation of the release assembly, the firing elements are released and move away from a first position within the training munition assembly. In some embodiments, operation 304 includes disengaging a firing element support 240 (see FIG. 4) from a plurality of firing elements 204 disposed within the training munition assembly 200 (e.g., within the interior cavity of the case, etc.). Operation 304 may further include moving (e.g., propelling, etc.) the firing elements 204 to reduce a spring force acting on each of the firing elements 204 by respective ones of a plurality of spring elements 206 disposed within the training munition assembly 200.

In some embodiments, operation 304 includes moving the firing elements 204 at different rates and/or along different distances within the interior cavity 216 responsive to actuation of the release assembly 208. For example, operation 304 may include moving the first firing element 204*a* from a first position within the interior cavity to a second position within the interior cavity over a first time period (e.g., see first time period 408 of FIG. 9), and moving the second firing element 204*b* from a third position within the interior cavity to a fourth position within the interior cavity over a second time period (e.g., see second time period 410 of FIG. 9). In some embodiments, the first time period 408 is different from the second time period 410. Operation 304 may include moving the first firing element 204*a* across a first distance along the interior cavity 216 and moving the second firing element 204*b* across a second distance along the interior cavity 216 that is different from the first distance.

In some embodiments, operation 304 may include moving the first firing element 204*a* at a first rate (e.g., a first speed, a first acceleration, etc.) along the interior cavity 216 and moving the second firing element 204*b* at a second rate (e.g., a second speed, a second acceleration, etc.) along the interior cavity 216 that is different from the first rate. For example, the training munition assembly may include multiple spring elements 206 having a different stiffness (e.g., spring constant, etc.), wire diameter, and/or pitch from one another to produce different forces on each of the firing elements. In other embodiments, the firing elements 204 may have different masses and/or shapes to change the rate of acceleration between the firing elements 204. In yet other embodiments, the firing elements 204 may have a different surface area of contact between the case and/or the release assembly 208.

At operation 306, the firing elements 204 generate a firing signature that is indicative of a firing event associated with the weapon. As used herein, "firing signature" refers to a vibrational and/or acceleration profile (e.g., acceleration waveform, etc.) that is associated with a single firing event (e.g., associated with depressing the trigger of a weapon a single time, associated with a single actuation of the training munition assembly, etc.). The acceleration profile may include pulses that are indicative of the movement of firing elements within the case 202.

Figure 8:
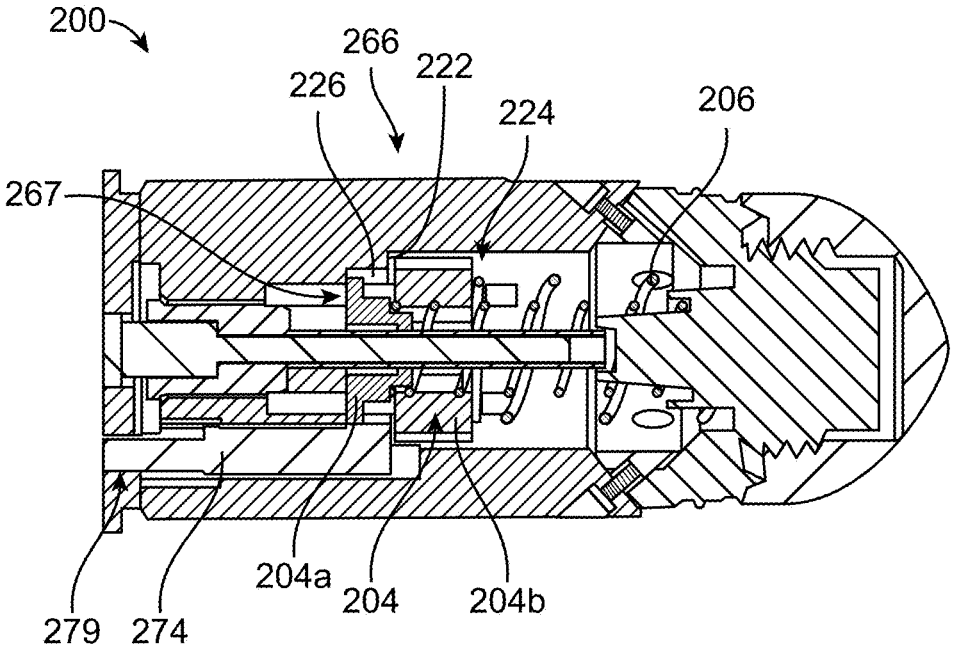
FIG. 8 is a side cross-sectional view of the training munition assembly of FIG. 2, shown with the training munition assembly in a fired condition, according to an embodiment.

Referring to FIG. 8, in some embodiments, operation 306 includes generating a plurality of acceleration pulses, where each pulse is indicative of a respective one of the firing elements 204 impacting an inner wall 205 of the case 202 and/or at least one firing element 204 impacting another firing element 204. In the embodiment of FIG. 8, the first firing element 204*a* generates a first pulse (e.g., a first acceleration, etc.) responsive to impact between the first firing element 204*a* and an inner wall of the case 202 that defines at least a portion of the second region 226. The second firing element 204*b* generates a second pulse (e.g., a second acceleration, etc.) responsive to impact between the second firing element 204*b* and an inner wall of the case 202 that defines the step 222 (and a distal end of the first region 224). In some embodiments, the pulses may occur close to one another so that the pulses together define a single uniquely shaped pulse and/or waveform (e.g., a region of increased acceleration which may include one or more spikes, and/or different rates of change of acceleration along the region, etc.).

Figure 9:
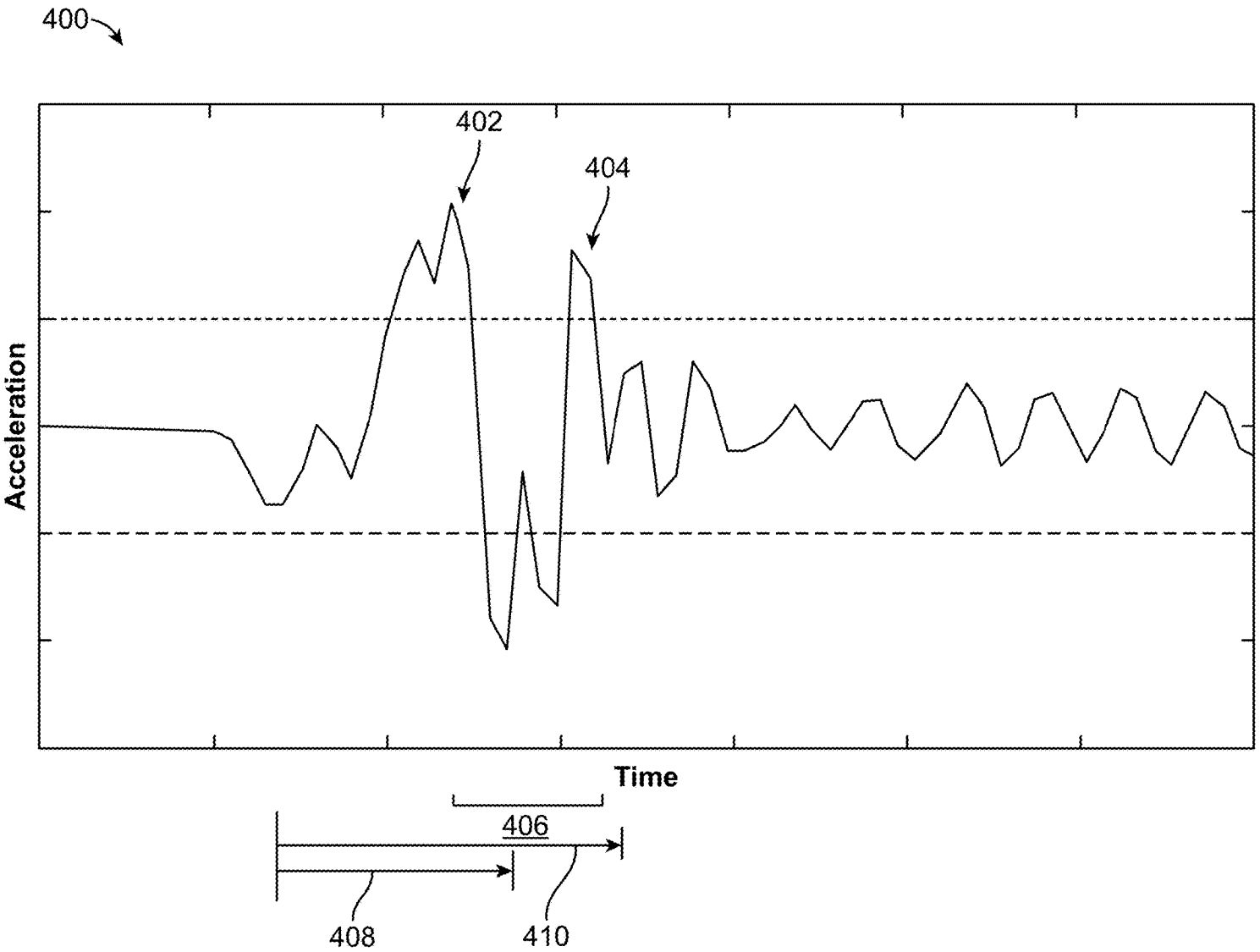
FIG. 9 is a plot of acceleration as a function of time during a firing event of a training munition assembly, according to an embodiment.

The vibrational pulses may be detectible by an accelerometer mounted to the weapon during the firing event. For example, referring to FIG. 9, operation 306 may include obtaining acceleration data associated with movement of the plurality of firing elements within the training munition assembly. The example data of FIG. 9 shows a unique weapon acceleration signature, shown as a firing signature 400, that includes multiple pulses, shown as a first pulse 402 and a second pulse 404 that are separated from one another by an impact period 406. The firing signature 400 may be indicative of a measured acceleration of the weapon during a firing event with the training munition assembly.

The duration of the impact period 406 between pulses and the magnitude of each pulse can vary depending on the design of the firing elements and spring elements for the training munition assembly, resulting in a firing signature that is difficult to replicate. Such a firing signature, which includes pulses of different magnitude spaced over a specific time period, can be very difficult to reproduce manually, which reduces the risk of false positive firing events during training exercises. The pulses can also simulate the recoil associated with firing the weapon during combat (e.g., forces that a user can perceive), which can be helpful to better familiarize military personnel with their weapons during training.

In some embodiments, operation 306 also includes actuating (e.g., repositioning, etc.) a discharge indicator of the training munition assembly. In some embodiments, as shown in FIG. 8, operation 306 includes engaging at least one of the firing elements (e.g., the second firing element, etc.) with a discharge indicator 274 and depressing the discharge indicator 274 toward a window 279 (e.g., an opening, etc.) at an axial end of the training munition assembly to provide a visual indication to a user that the training munition assembly is in a fired position (e.g., that the firing elements have moved to a second position within the training munition assembly).

Method of Manufacturing a Training Munition Assembly

Figure 10:
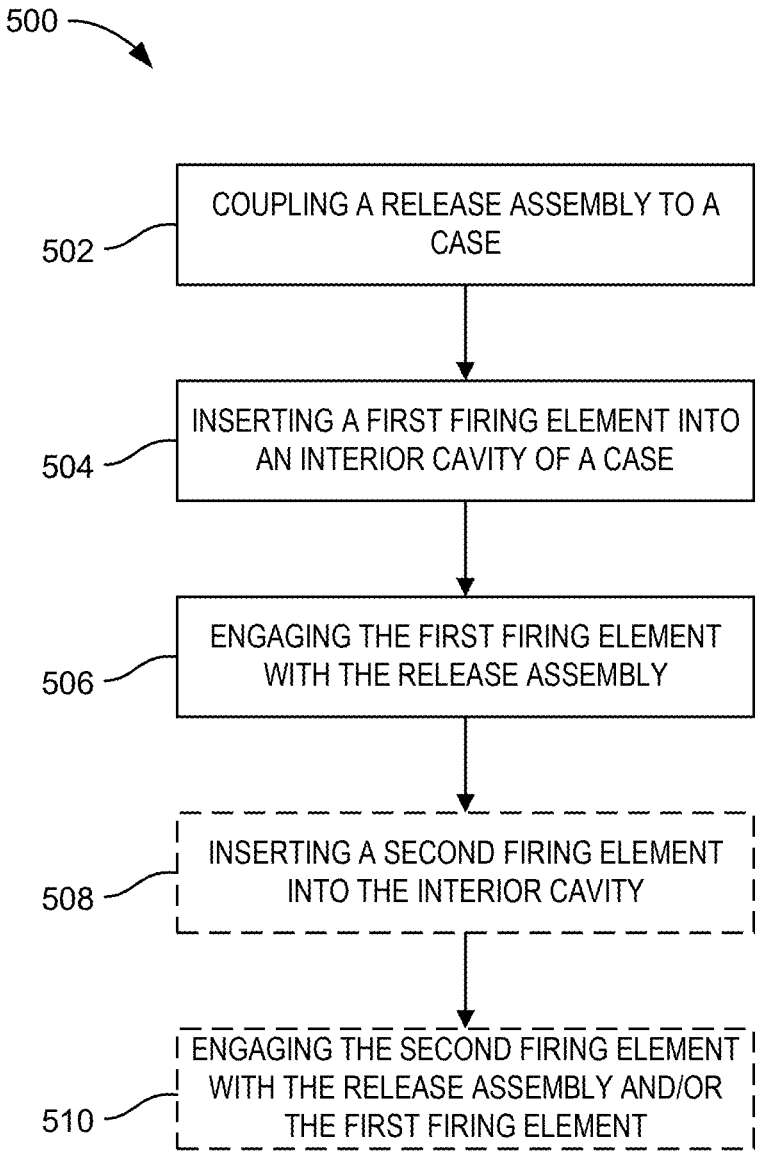
FIG. 10 is a flow diagram of a method of making a training munition assembly, according to an embodiment.

Referring to FIG. 10, a method 500 of making a training munition assembly is shown, according to an embodiment. The method 500 may be used to manufacture the training munition assembly 200 described with reference to FIGS. 2-5. In other embodiments, the method 500 may include additional, fewer, and/or different operations.

At operation 502, a release assembly is coupled to a case. In some embodiments, operation 502 includes coupling the release assembly to the case so that the release assembly extends into an interior cavity that is defined by the case. In such instances, operation 502 may include inserting a release pin of the release assembly into the interior cavity. Operation 502 may also include inserting a release actuator into the release pin to engage the release actuator with a firing element support.

At operation 504, a first firing element is inserted into the interior cavity of the case. In some embodiments, operation 504 includes aligning the first firing element with the interior cavity along a central axis of the interior cavity, and pushing the first firing element into the interior cavity.

At operation 506, the first firing element is engaged with the release assembly. Operation 506 includes engaging the first firing element with the release assembly such that actuation of the release assembly causes movement of the first firing element from a first position within the interior cavity to a second position within the interior cavity (e.g., a second position that is spaced axially apart from the first position, etc.). In some embodiments, operation 506 includes pushing the first firing element into contact with a firing element support of the release assembly. In some embodiments, operation 506 includes compressing a first firing element against the release assembly by engaging a first spring element with the first firing element. In such instances, operation 506 may further include securing a nose cover to the case of the training munition assembly to support the first spring element in compression against the first firing element.

At operation 508, a second firing element is inserted into the interior cavity. In some embodiments, operation 508 includes aligning the second firing element with the interior cavity along a central axis of the interior cavity, and pressing the second firing element into the interior cavity and toward the first firing element.

At operation 510, the second firing element (e.g., an axial end surface of the second firing element) is brought into contact or otherwise engaged with the first firing element and/or the release assembly. In some embodiments, operation 510 includes engaging the second firing element with the first firing element and/or the release assembly such that actuation of the release assembly causes movement of both the first firing element and the second firing element.

In some embodiments, the method 500 further includes compressing the second firing element against the first firing element and/or the release assembly by engaging a second spring element with the first firing element. In such instances, the method 500 may further include securing a nose cover to the case of the training munition assembly to support the second spring element in compression against the second firing element.

Exemplary Computing Systems

In some embodiments, the data detected by the accelerometer may be transmitted to a data logger, e.g., in the form of a computing system having a memory in the form of a non-transitory computer readable medium configured to store the accelerometer data, and a processor configured to process the accelerometer data. The processor may be further configured to communicate with the accelerometer. Additionally, the computer can be configured to communicate with a display, e.g., to depict a plot of acceleration versus time, such as the plot shown in FIG. 9. Such data may be collected for multiple users over the course of a training period and used to assess the user's performance over time. Training data may be compiled to allow for generation of statistical data and analysis for individual users and/or groups of users (e.g., a population group such as new recruits).

Figure 11:
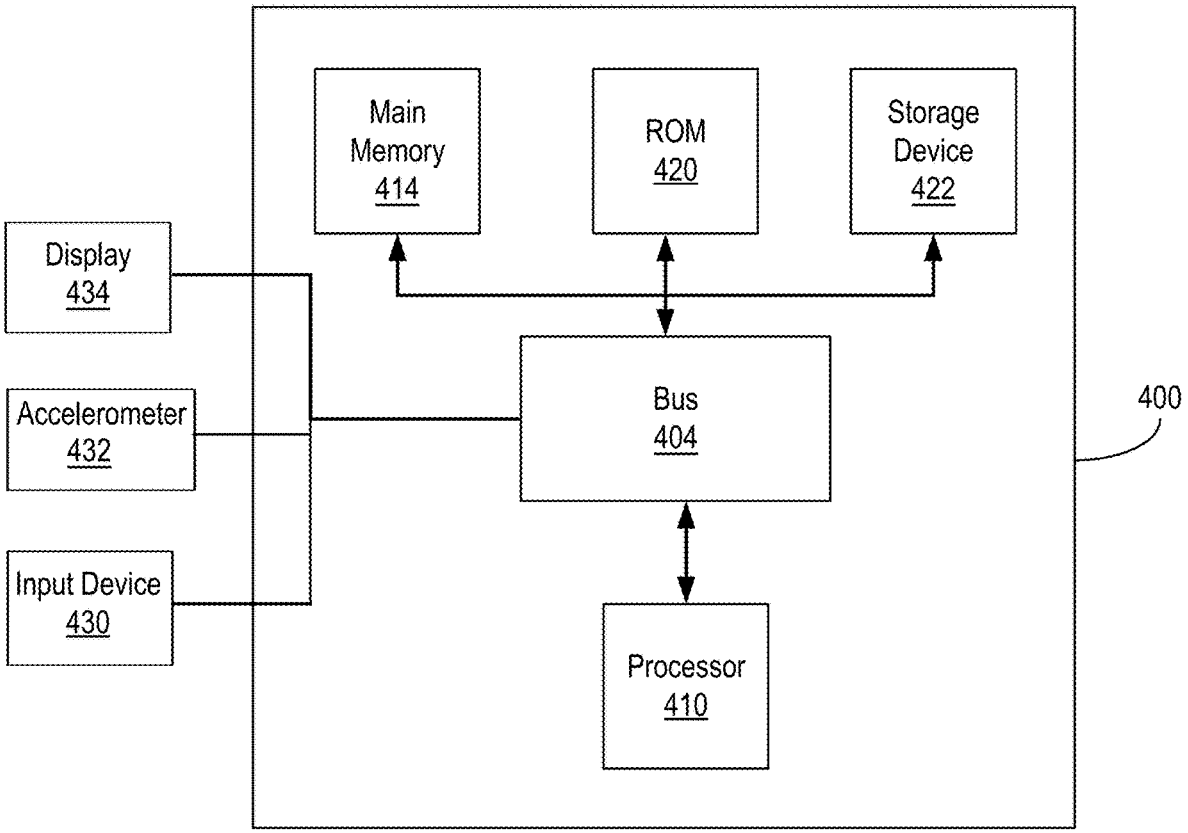
FIG. 11 is a block diagram illustrating an architecture for a computer system that can be employed to implement elements of the systems and methods described and illustrated herein.

FIG. 11 is a block diagram of an example computing system 400. The computing system 400 includes at least one bus 404 or other communication component for communicating information and at least one processor 410 or processing circuit coupled to the bus 404 for processing information. The bus 404 can receive information from accelerometer 432, for example. The computing system 400 also includes at least one main memory 414, such as a random access memory ("RAM") or other dynamic storage devices, coupled to the bus 404 for storing information, and instructions to be executed by the processor 410. The main memory 414 can be or include the memory or storage device. For example, a log of accelerometer information may be stored in main memory 414. The computing system 400 may further include at least one read only memory ("ROM") 420 or other static storage device coupled to the bus 404 for storing static information and instructions for the processor 410. A storage device 422, such as a solid state device, magnetic disk or optical disk, can be coupled to the bus 404 to persistently store information and instructions.

The computing system 400 may be coupled via the bus 404 to a display 434, such as a liquid crystal display, or active matrix display, for displaying information to a user. An input device 430, such as a keyboard or voice interface may be coupled to the bus 404 for communicating information and commands to the processor 410. The input device 430 can include a touch screen display 434. The input device 430 can also include a cursor control, such as a mouse, a trackball, or cursor direction keys, for communicating direction information and command selections to the processor 410 and for controlling cursor movement on the display 434.

The processes, systems, and methods described herein can be implemented by the computing system 400 in response to the processor 410 executing an arrangement of instructions contained in main memory 414. Such instructions can be read into main memory 414 from another computer-readable medium, such as the storage device 422. Execution of the arrangement of instructions contained in main memory 414 causes the computing system 400 to generate plots of acceleration over time as shown in FIG. 9. One or more processors in a multi-processing arrangement may also be employed to execute the instructions contained in main memory 414. Hard-wired circuitry can be used in place of or in combination with software instructions together with the systems and methods described herein. Systems and methods described herein are not limited to any specific combination of hardware circuitry and software.

Although an example computing system has been described in FIG. 11, the subject matter including the operations described in this specification can be implemented in other types of digital electronic circuitry, or in computer software, firmware, or hardware, including the structures disclosed in this specification and their structural equivalents, or in combinations thereof.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such coupling may be mechanical, electrical, or fluidic.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. The systems and methods described herein may be embodied in other specific forms without departing from the characteristics thereof. The foregoing implementations are illustrative rather than limiting of the described systems and methods. The scope of the systems and methods described herein is thus indicated by the appended claims, rather than the foregoing description, and changes that come within the meaning and range of equivalency of the claims are embraced therein.

What is claimed is:

1. A training munition assembly comprising:

a case defining an interior cavity;

a first firing element disposed within the interior cavity;

a second firing element disposed within the interior cavity; and a release assembly coupled to the case and engaging the first firing element, the release assembly configured to cause movement of the first firing element from a first position within the interior cavity to a second position within the interior cavity responsive to actuation of the release assembly from outside of the case, and to cause movement of the second firing element from a third position within the interior cavity to a fourth position within the interior cavity, the movement configured to generate a firing signature that is indicative of actuation of the release assembly.

2. The training munition assembly of claim 1, wherein, responsive to actuation of the release assembly, the first firing element is configured to move from the first position to the second position over a first time period, and the second firing element is configured to move from the third position to the fourth position over a second time period that is different from the first time period.

3. The training munition assembly of claim 1, wherein the second firing element is configured to move independently from the first firing element as the first firing element moves from the first position to the second position.

4. The training munition assembly of claim 1, wherein the firing signature includes an acceleration profile that is detectible by an accelerometer.

5. The training munition assembly of claim 1, wherein the second firing element is engaged with the first firing element so that the first firing element substantially prevents movement of the second firing element in at least one direction in both the first position and the second position.

6. The training munition assembly of claim 1, further comprising a cover coupled to the case and enclosing the interior cavity, the cover and the case together defining a simulated munition casing that is insertable into a breech or magazine of a weapon.

7. The training munition assembly of claim 1, further comprising a discharge indicator that is configured to provide a visual indication of whether the first firing element is in the first position or the second position and/or whether the second firing element is in the third position or the fourth position.

8. The training munition assembly of claim 1, further comprising a spring element configured to support the first firing element in compression against the release assembly when the first firing element is in the first position.

9. The training munition assembly of claim 7, further comprising:

a second spring element configured to support the second firing element in compression.

10. A training munition assembly comprising:

a case defining an interior cavity;

a plurality of firing elements disposed within the interior cavity; and a release assembly that is actuatable to selectively allow movement of the plurality of firing elements along the interior cavity, the plurality of firing elements configured to move at different rates along the interior cavity responsive to actuation of the release assembly.

11. The training munition assembly of claim 10, further comprising:

a first spring element supporting a first firing element of the plurality of firing elements against the release assembly; and a second spring element supporting a second firing element of the plurality of firing elements against the release assembly.

12. The training munition assembly of claim 11, wherein the first spring element has a first spring force characteristic, and the second spring element has a second spring force characteristic that is different from the first spring force characteristic.

13. The training munition assembly of claim 10, wherein the release assembly includes a firing element support that is configured to selectively engage at least one of the plurality of firing elements to control movement of at least one of the plurality of firing elements.

14. The training munition assembly of claim 10, wherein a first firing element of the plurality of firing elements has a different shape than a second firing element of the plurality of firing elements.

15. The training munition assembly of claim 10, wherein, responsive to actuation of the release assembly, a first firing element of the plurality of firing elements is configured to move at a first rate along the interior cavity, and a second firing element of the plurality of firing elements is configured to move at a second rate along the interior cavity that is different from the first rate.

16. The training munition assembly of claim 10, wherein the case defines a reset aperture that enables access to at least one firing element of the plurality of firing elements within the interior cavity.

17. A method of manufacturing a training munition assembly, the method comprising:

coupling a release assembly to a case so that the release assembly extends into an interior cavity that is defined by the case;

inserting a first firing element into the interior cavity;

inserting a second firing element into the interior cavity; and engaging the first firing element with the release assembly that is configured to selectively control movement of the first firing element within the interior cavity from a first position within the interior cavity to a second position within the interior cavity; and engaging the second firing element with the first firing element and/or the release assembly such that actuation of the release assembly causes movement of both the first firing element and the second firing element.

18. The method of claim 17, further comprising compressing the first firing element against the release assembly by engaging a spring element with the first firing element.

* * * * *